US005427510A

United States Patent [19]

Hisanaga et al.

[11] Patent Number: 5,427,510

[45] Date of Patent: Jun. 27, 1995

[54] SCROLL TYPE COMPRESSOR HAVING ECCENTRIC INCLINED DRIVING MEANS

[75] Inventors: Shigeru Hisanaga; Hirotaka Egami; Yasushi Watanabe; Tetsuhiko Fukanuma, all of Kariya, Japan

[73] Assignees: Nippondenso Co., Ltd.; Kabushiki Kaisha Toyota Jidoshokki Seisakusho, both of Kariya, Japan

[21] Appl. No.: 304,846

[22] Filed: Sep. 13, 1994

[30] Foreign Application Priority Data

Sep. 14, 1993 [JP] Japan ..... 5-229048

[51] Int. Cl.[6] ..... F04C 18/04

[52] U.S. Cl. ..... 418/14; 418/55.5; 418/57

[58] Field of Search ..... 418/14, 55.5, 57

[56] References Cited

U.S. PATENT DOCUMENTS 5,017,107 5/1991 Fraser, Jr. et al. ..... 418/55.5

5,197,868 3/1993 Caillat et al. ..... 418/55.5

FOREIGN PATENT DOCUMENTS 2176179 7/1990 Japan .

4311691 11/1992 Japan ..... 418/55.5

*Primary Examiner*—John J. Vrablik

*Attorney, Agent, or Firm*—Cushman, Darby & Cushman

[57] ABSTRACT

A scroll type compressor which prevents occurrence of abnormally high pressures due to liquid compression at the time of startup so as to lighten the engine load by providing a projection on the end face of the shaft and a groove in which the projection fits in the end face of the bush supporting a movable scroll member, the projection and groove being arranged so that their abutting faces are inclined a predetermined angle with respect to a line connecting the center of the shaft and the center of the bush in the direction opposite to the rotational direction of the shaft and being positioned relative to each other so that the extension line of the abutting faces passes through the side opposite to the side where the center of the bush is positioned seen from the center of the shaft.

6 Claims, 6 Drawing Sheets

SCROLL TYPE COMPRESSOR HAVING ECCENTRIC INCLINED DRIVING MEANS

BACKGROUND OF THE INVENTION

1. Field of the Invention

The present invention relates to a scroll type compressor suitable for use as a refrigerant compressor for an automobile air-conditioner.

2. Description of the Related Art

Such a scroll type compressor is disclosed in numerous patents and references and the principles behind its operation are well known.

In a scroll type compressor, several hermetic spaces are created enclosed by a plurality of contact lines formed by a fixed scroll member and movable scroll member engaging with each other. When the movable scroll member performs revolutionary motion, the contact lines move from the outer periphery toward the center along the walls of the spiral bodies. Along with this, the enclosed hermetic spaces also move toward the center and compresses a refrigerant or other fluid while being reduced in volume.

Since a plurality of these contact lines are formed, however, the shapes of the spiral bodies must be kept to an error from the predetermined shapes on the order of several microns. Further, strict precision of the relative positions of the two scroll members is required. If these errors become too great, they end up separating at one of the plurality of contact lines and the hermetic degree of the space to be hermetically sealed falls, so the amount of discharge falls, the power consumption rises, and an abnormally high temperature operation state is caused. Accordingly, in a scroll type compressor, it is necessary to make the precision of processing of the spiral bodies and the precision of assembly of the two scroll members extremely high. This is the main reason why scroll type compressors were not put into practical use for a long time. There are also various difficulties even with today's processing technologies and assembly technologies.

To solve these problems in a scroll type compressor, proposal has been made in numerous patent specifications of a means for changing the radius of the revolutionary motion of the movable scroll member along with the shape of the scroll member. For example, in the compressor disclosed in Japanese Unexamined Patent Publication (Kokai) No. 2-176179, the end of the shaft is provided with a drive projection having a planar face, the bush for giving revolutionary motion to the movable scroll member is provided with a groove having a planar face, and the drive projection is fitted slidingly in the groove. It has been proposed that the planar face of the drive projection be inclined with respect to the line connecting the center of the bush and the center of the shaft in the direction opposite to the direction of rotation of the shaft.

If this construction is adopted, the bush receives a compression reaction force from the movable scroll member engaged in the revolutionary motion. Due to this reaction force, the bush moves along the planar face of the drive projection. As a result of this movement and due to this positional relationship, the distance between the center of the bush and the center of the shaft, that is, the radius of revolutionary motion, becomes larger than the state before movement. This is due to the fact that while the movable scroll member is revolving, a force acts so that the radius of revolution always becomes larger and that even if there is some error in the formation of the scroll members, the movable scroll member adjusts its radius of revolution along with that shape and reliably forms the contact lines.

With the above configuration, however, several problems occurred at the time of liquid compression. That is, the refrigerant would liquefy and flow into the compressor if it were stopped for a long period of time. If the compressor were started from this state, the refrigerant would be compressed as a liquid in the compressor, an abnormally high pressure would be caused, and the abnormally high pressure would cause breakage and seizure of the scroll teeth, damage to the discharge valve, and burnout at the frictional face of the solenoid clutch, not shown. Therefore, by operating the compressor so that the movable scroll member moves with respect to the fixed scroll member while the compressor is idle, that is, in a state where the radius of revolution becomes smaller and a clearance is caused between side faces of the scroll members in the time after startup until the compression reaction force becomes sufficiently large, it is possible to mitigate the sharp rise of the load on the vehicle engine and to prevent in advance vibration and shock at the time of startup of the compressor.

In practice, however, it is difficult to arrange enough of a balance weight to completely balance the centrifugal force of the movable scroll member due to the size involved, so due to the remaining centrifugal force of the movable scroll member, the movable scroll member ends up moving in the direction giving a larger radius of revolution immediately after startup. As a result, full use is not made in practice of the function of mitigation of the startup load.

Even at startup accompanied with liquid compression, for the same reason as with the residual centrifugal force, the radius of revolution increases immediately after startup, the clearance between side walls of the scroll members decreases, a rise in liquid pressure is immediately caused, and as a result various problems arise such as slipperiness of the frictional face of the solenoid clutch causing burnout, generation of abnormal noise due to sudden liquid compression, and damage to the scroll members. However, these are problems which can be prevented in advance by making sufficient use of the mitigating function on the startup load in the same way as above.

SUMMARY OF THE INVENTION

The present invention was made in consideration of the above problems and has as its object the provision of a means for preventing the occurrence of abnormally high pressure caused by liquid compression by making the movable scroll member move in the state of the small radius of revolution at the time of startup, that is, the state where a clearance is formed between the side wall of the movable scroll member and the side wall of the fixed scroll member.

Further, the present invention has as another object the provision of a means for mitigating the load on the vehicle engine driving the compressor at the time of startup of the compressor.

According to the present invention, the shaft and bush are provided with a projection and a groove into which the projection fits. When the projection is inserted into the groove, the abutting faces of the two are made to be inclined by a certain angle $\theta$ with respect to the line connecting the center of the shaft and the center of the bush.

Due to this, when the shaft rotates, the movable scroll member, which is inhibited from free rotation, can engage in revolutionary motion by the radius RI. At this time, however, a compression reaction force F acts on the bush toward the center of the bush in the tangential direction of the orbit of the revolutionary motion. The component F·sin $\theta$ becomes a force pushing the bush up.

If length of the groove is made a predetermined amount larger than that of the projection, then the bush moves along the groove. That is, the radius of revolution becomes larger than even the initial RI, the movable scroll member abuts and slides along the shape of the fixed scroll member, and the spaces between teeth are reliably sealed.

Further, by suitably selecting the inclination angle $\theta$, it is possible to prevent the occurrence of an excessive pressing force. Further, when the shaft reverses at the time of stopping the operation, the bush moves in the reverse direction, but the projection abuts against the end face of the groove and therefore the movement of the bush is limited before the movable scroll member violently strikes the fixed scroll member.

In this way, with just the projection and groove having planar faces, it is possible to realize a driven crank mechanism having both the function of adjusting the radius of revolution by a suitable pressing force and a stopper function for preventing collision between teeth.

Further, in the present invention, the abutting faces of the projection and groove or the extension line of the same are positioned to pass through the side opposite to the side where the center of the bush is positioned as seen from the center of the shaft. Due to this, at the time of startup, the inertia force of the movable scroll member and the bush acts on the abutting faces of the projection and groove and moves the movable scroll member in the direction giving a smaller radius of revolution. For this reason, at startup, it is possible to form a clearance at the contact lines between the movable scroll member and the fixed scroll member and it is possible to use this clearance to prevent liquid compression and lighten the load at the time of startup. In particular, this action is caused by the inertia force of the movable scroll member and the bush when rotation is started, so this inertia force also disappears a short time after the startup when the steady state operation begins. Therefore, in the present invention, it is possible to reduce just the load at the time of startup without detracting from the compression efficiency at the time of steady state operation.

BRIEF DESCRIPTION OF THE DRAWINGS

These and other objects and features of the invention will become more apparent from the following description of the preferred embodiments made with reference to the appended drawings, in which.

DESCRIPTION OF THE PREFERRED EMBODIMENTS

An embodiment of the present invention will now be explained in detail with reference to the drawings.

Figure 1:
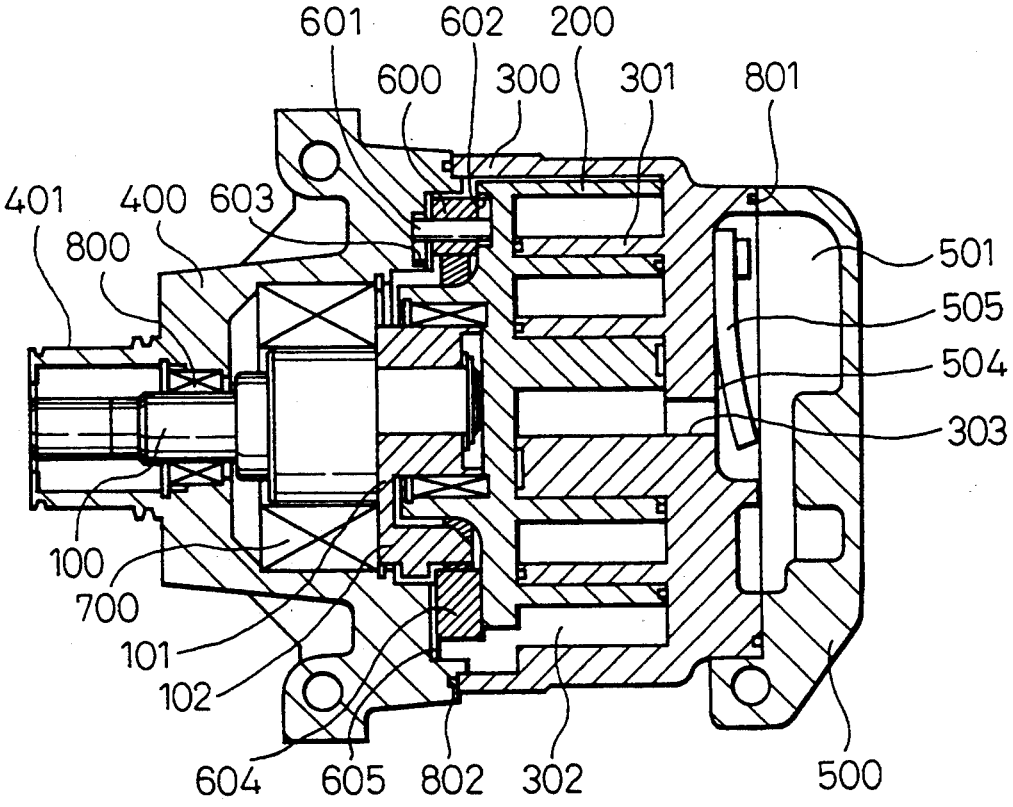
FIG. 1 is a cross-sectional view of an embodiment of the compressor of the present invention.

FIG. 1 shows an embodiment of the scroll type compressor according to the present invention. The casing of the compressor is formed by a rear housing 500, a shell 300, and a front housing 400 which is tightened and emplaced by not shown bolts so as to close off the opening of the shell. The rear housing 500, shell 300, and front housing 400 are all made of an aluminum alloy casting (die casting). The front housing 400 has a hole in its center, in which are affixed the bearings 700 which rotably support the shaft 100. Further the front housing 400 has a cylindrically shaped boss 401, in which is assembled a shaft seal 800. On the outer circumference of the boss 401 is attached a magnetic clutch, not shown, through which magnetic clutch the rotational force of the automobile engine is transmitted to the shaft 100. In the shell 300 is integrally formed a fixed scroll member 301. The rear housing 500 is affixed by not shown bolts. The rear housing 500 is affixed in an air-tight manner and forms a high pressure chamber 501 with the shell 300 and O-ring 801. In the rear housing 500 is formed a not shown discharge port. On the other hand, the front housing 400 is affixed in an air-tight manner through an O-ring 802 to the shell 300, which has inside it a low pressure chamber 302 and a suction port, not shown, communicated with the same. (As explained above, the shell 300 is integrally formed with the fixed scroll member 301.) Further, in the shell 300 is disposed the movable scroll member 200 shifted in angle with respect to the fixed scroll member 301 so that the spiral bodies engage with each other. The movable scroll member 200 is connected to a rotation preventing mechanism 600 which inhibits free rotation. In the rotation preventing mechanism 600, three or more pins are held rotably at a certain interval from each other on the circumference. On the other hand, the face of the end plate of the movable scroll member 200 abutting against the rotation preventing mechanism 600 has embedded in it steel sleeves 602 in the same number of holes as the pins 601. Further, sleeves 603 are similarly embedded in the face of the front housing 400 facing the sleeve 602 at the same positions. In the sleeve inner circumferential space formed by the three or more pairs of sleeves 602 and sleeves 603, the rotation preventing mechanism 600 is attached so as to engage with the pins. The attached rotation preventing mechanism 600 has a clearance of tens of microns from the end plate of the movable scroll member abutting against it and the face of the front housing 400 in which the sleeves 603 are embedded, so relative motion with the two is possible. Further, the inner diameters of the sleeves 602 and 603 are formed to be larger than the outer diameters of the pins 601 by exactly the radius of revolution, so the movable scroll member 200 can engage in revolutionary motion without being obstructed by the rotation preventing mechanism 600. At this time, the rotation preventing mechanism 600 is engaged with the sleeves 602 and 603 due to the relationship of the dimensions of the inner and outer circumferences, so revolves with a radius of ½ of the radius of revolution of the revolutionary motion linked with the revolutionary motion of the movable scroll member 200. At this time, the pins 601 revolve while freely rotating and abutting against the inner circumferential faces of the pair of sleeves 602 and 603. Here, if the movable scroll member 200 tries to freely rotate, at one or more of the engagement portions of the three groups of pins 601 and pairs of sleeves 602 and 603, a pin 601 will be caught between the inner circumferential faces of the pair of sleeves 602 and 603, whereby the rigidity of the pin 601 will inhibit the movable scroll member 200 from freely rotating through the sleeves 602 and 603 at the front housing 400. In this way, the movable scroll member 200 is inhibited from free rotation by the rotation preventing mechanism 600. Therefore, it receives the drive force from the later mentioned bush 101 and performs revolutionary motion for compression of the refrigerant gas. The rotation preventing mechanism 600 has an axial load bearing portion 604 on its circumference other than the portion of the pins 601 which stably supports the movable scroll member 200 receiving the axial load together with the face of the sleeve 603 of the front housing 400. The face having the sleeve 602 of the movable scroll member 200 in sliding contact with the axial load bearing portion 604 is given a nickel-boron plating in the same way as the scroll teeth to avoid seizure and wear. Also, between the axial load bearing portion 604 and the front housing 400 is disposed a steel or iron plate 605 for avoiding seizure and wear. Further, the shaft 100 is provided with a balance weight 102 for canceling out the centrifugal force caused by the revolutionary motion of the movable scroll member 200.

The radius R of revolutionary motion is determined by the shape of the two scroll members, so the movable scroll member 200 is disposed so that the centers of the two scroll members are separated by exactly that radius R.

That is, due to the rotation of the shaft 100, the movable scroll member 200 performs revolutionary motion with the radius R through the bush 101. As a result, the contact lines formed between the two scroll members move toward the center along the shape of the spiral bodies and the hermetic spaces move toward the center while being reduced in volume. The refrigerant is compressed in this way. Further, at the center of the fixed scroll member 301 is made a discharge port 303 for discharging the thus compressed refrigerant gas into the high pressure chamber 501. Further, there are provided a discharge valve 504 for preventing the backflow of the discharged refrigerant gas from the high pressure chamber 501 to the hermetic space of the spiral bodies and a stopper 505 for limiting the amount of lift of the discharge valve.

Figure 2:
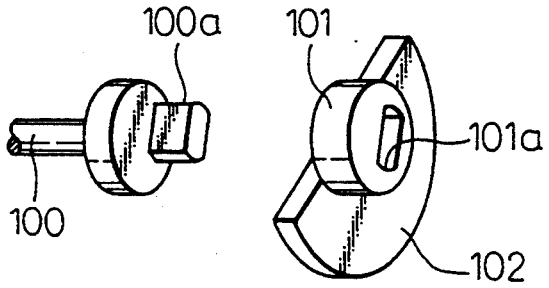
FIG. 2 is a perspective view of the shaft and bush shown in FIG. 1.
Figure 3:
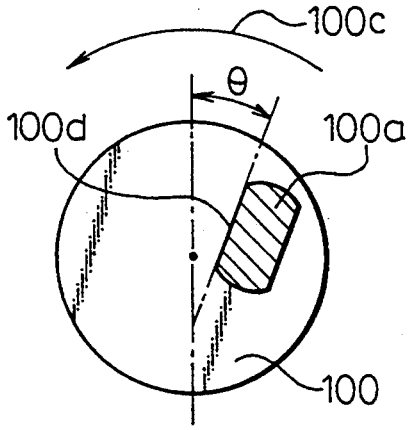
FIG. 3 is a front view of the drive portion of the shaft in the embodiment of FIG. 1.
Figure 4:
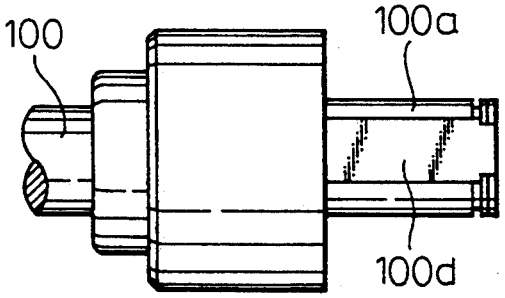
FIG. 4 is a side view of the shaft shown in FIG. 3.
Figure 5:
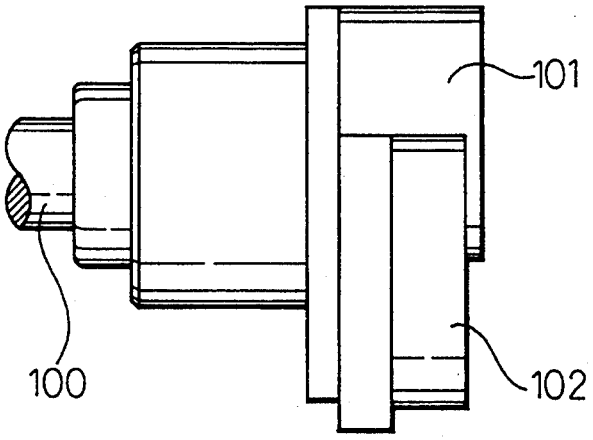
FIG. 5 is a side view of the bush shown in the embodiment of FIG. 1.

Next, an explanation will be made of the driven crank mechanism of the movable scroll member referring to the drawings. FIG. 2 shows the configuration of the driven crank mechanism. On the end face of the shaft 100 is integrally formed the drive projection 100*a* having at least one planar face. The drive projection 100*a* in turn has at least one planar face. In this example, as shown in FIG. 2 and FIG. 3, there is formed a key having two planar faces. The important planar face is the planar face 100*d* in the rotational direction of the shaft in FIG. 3. The drive force is transmitted to the bush 101 by the planar face. Further, the bush 101 can move in sliding contact with the planar face 100*d*. This will be explained in further detail using FIG. 8.

When the shaft 100 rotates in the direction 100*c*, the drive projection 100*a* integrally rotates. At that time, the bush 101 engaged with the projection rotates by the planar face 100*d* of the projection abutting against the planar face 101*d* of the bush groove 101*a*.

Due to the rotation of the bush 101, the movable scroll member 200 revolves and compresses the refrigerant. The compression reaction force F resulting from this acts on the bush 101. As a result, due to the reaction force F, the planar face 101*d* of the groove of the bush is pressed strongly against the planar face 100*d* of the drive projection of the shaft to increase the closeness of contact and the bush 101 moves along the planar face 100*d*. Accordingly, a clearance is formed between the planar face 100*h* at the side opposite to the abutting planar face 100*d* of the projection 100*a*, that is, the planar face 100*h* at the opposite side to the shaft rotational direction 100*c*, and the face of the bush groove 101*a*. Accordingly, so far as the movement of the bush is not obstructed, the opposite side face 100*h* and the facing face 101*b* of the bush groove 101*a* may be arcs or other free curves (see FIG. 11). In this example, the planar faces are formed to give some clearance between the faces with the object of limiting abnormal inclination of the bush 101.

Figure 6:
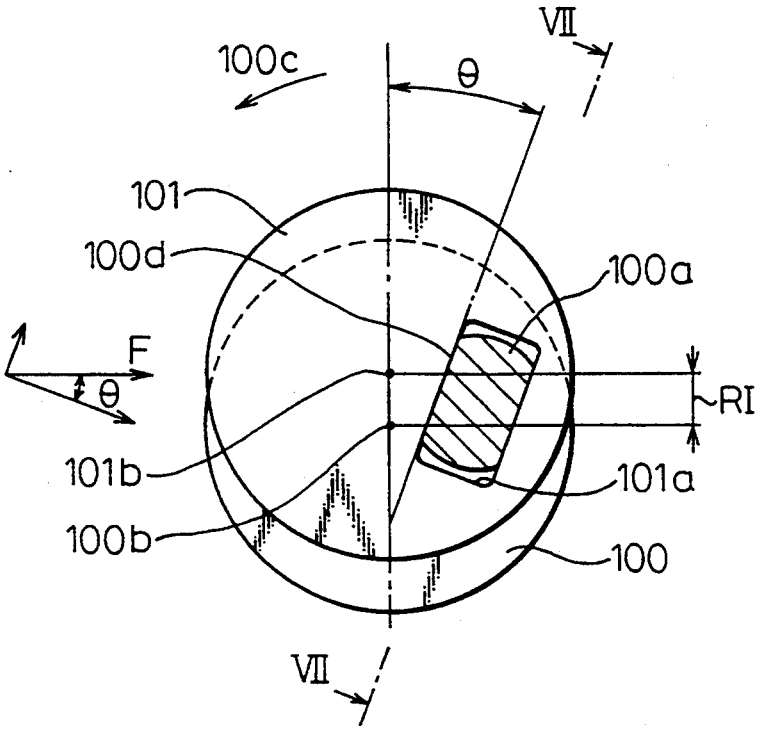
FIG. 6 is a front view seen from the right direction of FIG. 5.
Figure 7:
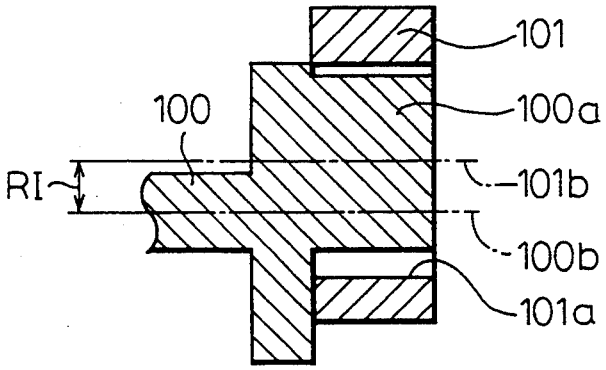
FIG. 7 is a cross-sectional view along the line VII—VII of FIG. 6.

The planar face 100*d* of the drive projection 100*a* is formed to be shifted by a certain angle $\theta$ with respect to the line passing through the center of the shaft in a direction opposite to the rotational direction as shown in FIG. 3 and FIG. 6. In this example, $\theta$ is made about 30°. On the other hand, as shown in FIG. 6, the bush 101 has formed in it a groove 101*a* into which the drive projection 100*a* fits and which receives the drive force of the same. The groove 101*a* is arranged so that the longitudinal direction dimension of the groove in this embodiment is larger than that of the drive projection 100*a*. In this example, it is set about 1 mm longer. Further, the width dimension of the groove is set larger than the width dimension of the drive projection by tens of microns so that the bush 101 can slide smoothly in the longitudinal direction while contacting the drive projection 100*a*. Further, to ensure a smooth sliding movement, the planar faces of the drive projection 100*a* and the groove 101*a* are polished to keep the surface roughness down to several microns. Also, the bush 101 is integrally provided with a balance weight 102 so as to cancel out the centrifugal force due to the revolutionary motion of the movable scroll member 200.

An explanation will now be made of the positional relationship and action of the shaft 100, drive projection 100*a*, bush 101, and groove 101*a* while referring to FIG. 6 to FIG. 9.

FIG. 6 shows the relative positional relationship between the shaft 100 and the bush 101 when all the constituent parts have been assembled and the compressor is completed. The distance between the center 100*b* of the shaft and the center 101*b* of the bush becomes RI, which is approximately equal to the above-mentioned radius of revolution R. The planar face 100*d* of the drive projection is inclined by a certain angle $\theta$ with respect to the line passing through the center 100*b* of the shaft and the center 101*b* of the bush in a direction opposite to the direction of rotational 100*c* of the shaft 100. When the shaft 100 rotates in the direction shown by 100*c* in this state, the bush 101 starts to rotate in the same way in the direction 100*c* through the planar face 100*d* of the drive projection. Here, the bush 101 is engaged with the movable scroll member 200 through the bearings etc., so due to the rotation of the bush 101, the movable scroll member 200 performs revolutionary motion and starts compressing the refrigerant or other fluid. At this time, a compression reaction force acts on the movable scroll member 200. As a result, a compression reaction force shown as F in FIG. 6 acts on the center 101*b* of the bush. This reaction force F is supported by the planar face 100*d* of the drive projection through the groove 101*a*, but as mentioned earlier, the drive projection 100*a* is arranged inclined at an angle of $\theta$, so a component force F·sin $\theta$ of the compression reaction force pushing the bush 101 up along the drive projection 100*a* is created. Due to this component force F·sin $\theta$, the bush 101, that is, the movable scroll member 200, tries to revolve by a radius larger than the initial radius of revolution RI. Due to this, even if there is some error in the shapes of the spiral bodies of the movable scroll member 200 and the fixed scroll member 301, the radius of revolution will automatically become larger until the spiral body of the movable scroll member abuts against the spiral body of the fixed scroll member and thereby revolutionary motion will be performed. Therefore, it is possible to reliably form the contact lines between the scroll members 200 and 301. The hermetic degree of the hermetic space increases and this contributes to the improvement of the performance of the compressor.

Figure 9:
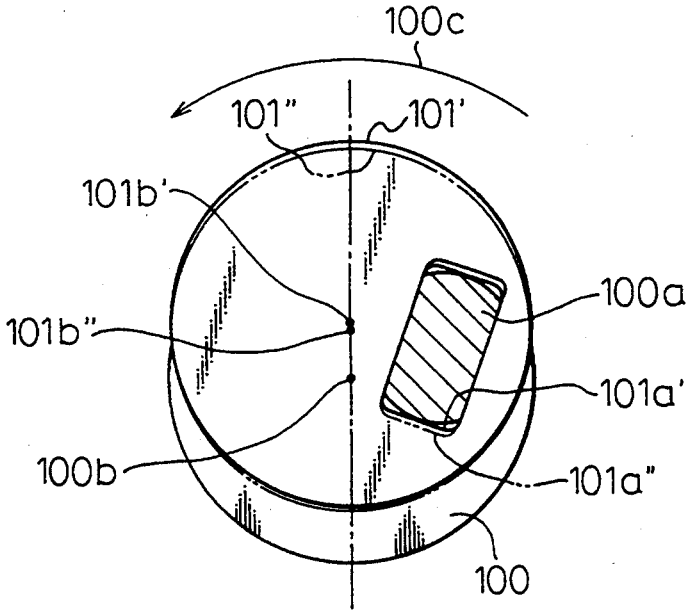
FIG. 9 is a view explaining the direction of movement of the bush due to the action of the force in FIG. 8.
Figure 10:
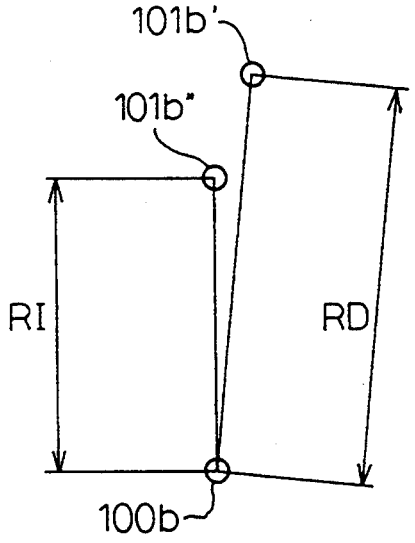
FIG. 10 is a schematic view explaining the increase in the radius of revolution after the bush moves as shown in FIG. 9.
Figure 11:
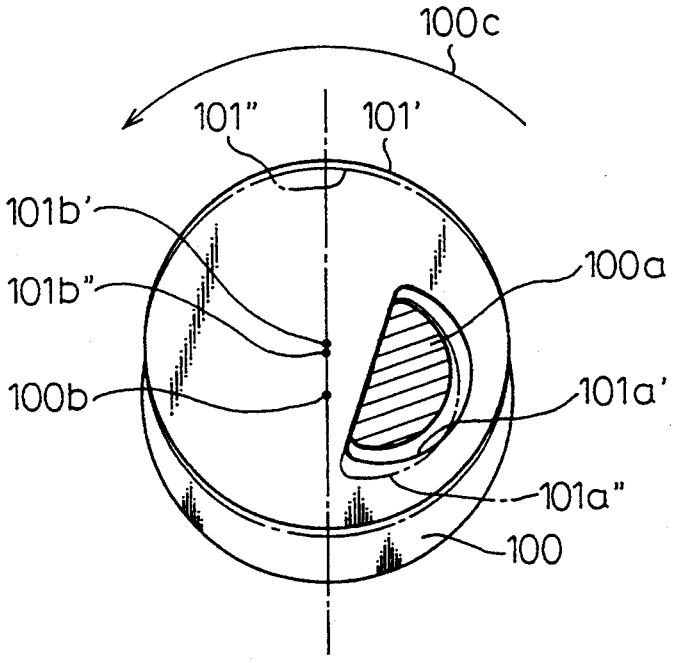
FIG. 11 is a front view of the state of insertion of the shaft and bush in another embodiment.

FIG. 9 is a view explaining the relative positional movement of the bush 101 caused by the component force F·sin $\theta$, while FIG. 10 shows the increase of the radius of revolution due to the movement of the bush. Further, FIG. 11 shows another embodiment corresponding to FIG. 9. In these figures, RI is the amount of eccentricity (initial radius of revolution), RD is the radius of revolution after the bush movement, 101' is the final position of the bush, 101'' is the initial position of the bush, 101*a'* is the final position of the groove, 101*a''* is the initial position of the groove, 101*b'* is the final position of the center of the bush, and 101*b''* is the initial position of the center of the bush.

Next, an explanation will be made of the action of the driven crank mechanism at the time of startup referring once again to FIG. 8.

In the present invention, the planar face 100*d* of the drive projection or its extension line passes through the side opposite to the center 101*b* of the bush across the line passing through the center 100*b* of the shaft and the center 101*b* of the bush as seen from the center 100*b*.

Figure 8:
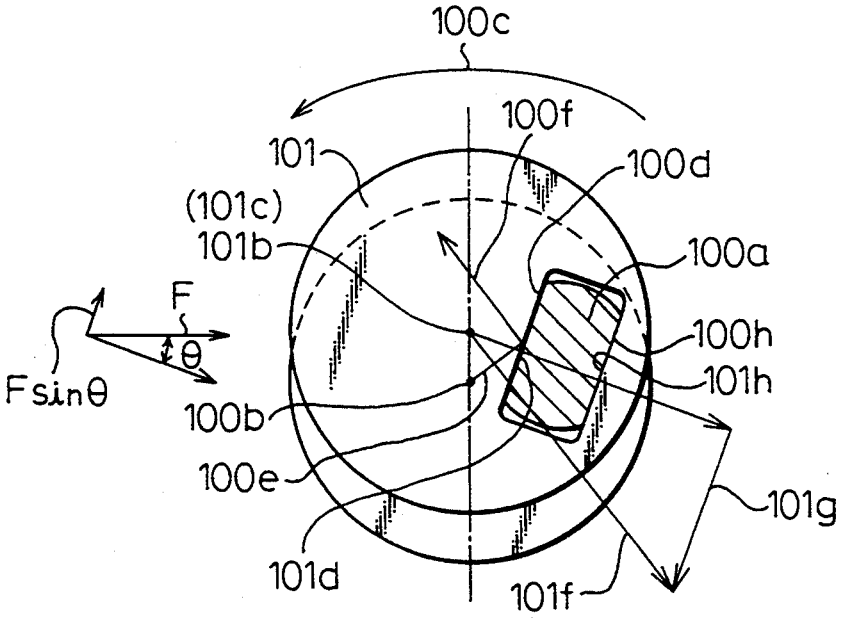
FIG. 8 is a view explaining dynamically the force acting on the bush in the embodiment of FIG. 1.

When the compressor is started up and the shaft 100 starts rotating, the planar face 100*d* of the drive projection starts to move in a direction and with an acceleration giving the vector 100*f* orthogonal to the line segment 100*e* from the center 100*b* of the shaft. Here, taking note of the center of gravity 101*c* of the movable scroll member 200 and the bush 101, the inertia force acts in the direction of the vector 101*f* having a direction exactly opposite to the acceleration 100*f* of the planar face 100*d* of the drive projection. In FIG. 8, the vector 101*f* has a downward facing component 101*g* along the abutting planar face 100*d* of the drive projection 100*a*, so due to that force 101*g*, the bush 101 moves downward along the planar face 100*d* of the drive projection. That is, it moves in a direction wherein the distance between the center 101*b* of the bush and the center 100*b* of the shaft (radius of revolution) becomes smaller. Here, to give the vector 101*f* a component 101*g* moving the bush 101 in the direction making the radius of revolution smaller, as proposed in the present invention, it is essential that the planar face 101*d* of the drive projection or the extension line of the same pass through the side opposite to the center 101*b* of the bush across the line passing through the line passing through the center 100*b* of the shaft and the center 101*b* of the bush as seen from the center 100*b*.

By adopting this configuration, at the time of startup of the compressor, it is possible to move the bush in the direction wherein the radius of revolution becomes smaller by the inertia force of the movable scroll member 200 and bush. Therefore, it is possible to form clearances at the contact lines of the side walls of the two scroll members 200 and 301 and possible to reduce the load at the time of startup. In particular, if liquid compression occurs at the time of startup, it is possible to allow fluid to escape from the clearances and thereby to prevent occurrence of an abnormally high pressure or an abnormally large torque and therefore to prevent in advance the damage or seizure of the scroll walls, damage to the discharge valve, burnout at the frictional face of the solenoid clutch, etc. Accordingly, it is possible to eliminate the need for a special relief valve for preventing liquid compression. Even in steady state startup, due to the clearance formed by the above action, it is possible to make the hermetic degree of the hermetic space enclosed by the two scroll members 200 and 301 fall and the compression gently rise, that is, the torque gently rise. This enables a sharp rise in the load to the engine of the vehicle side to be avoided and vibration and shock giving the passengers an uncomfortable feeling to be prevented.

Of course, due to the compression reaction force F, which gradually increases after startup, and the inclination angle $\theta$ of the planar face 100*d* of the drive projection, the radius of revolution increases, the clearance at the contact lines of the of the side walls of the two scroll members is reduced, and a normal operation state with a high hermetic property is shifted to. These problems all occur in the 1 to 2 seconds after startup and were seen to be resolved just by starting from motion of a small radius of revolution immediately after startup. The present inventors et al. investigated this and found that the time required for the radius of revolution to become larger and the hermetic degree of the hermetic space to become higher is just $\frac{1}{4}$ a shaft rotation (less than 15 msec) after startup in a conventional compressor, but is lengthened to about 2 shaft rotations (about 0.1 sec) in steady state startup and about 4 shaft rotations (about 0.2 sec) in startup along with liquid compression in the present invention. It was confirmed that the initial objectives can be sufficiently obtained by this prolongation of time.

Also, the inclination angle $\theta$, as mentioned above, determines the force Ftan $\theta$ pushing the movable scroll member 200 against the fixed scroll member 301. It was learned that to secure a hermetic degree under broad conditions of use and avoid an increase of the power consumption, breakage of the scroll wall, etc. caused by an excessive pressing force, it is sufficient to set $\theta$ from 20° to 30°.

The range of movement of the bush 101 is limited by the end faces of the drive projection 101*d*.

Further, a similar action is achieved even if a circlip or other engaging means or an inclination preventing means of the bush 101 is added to the front end of the drive projection.

In the above embodiment, further, the shaft 100 side was provided with the projection 100*a* and the bush side was provided with the groove 101*a*, but the projection 100*a* and groove 101*a* can be reversed in position. That is, even if the shaft 100 side is provided with the groove 101*a* and the bush 101 side is provided with the projection 100*a*, a similar action and effect can be obtained even if the positional relationship of the abutting faces 100*d* and 101*d* is similar to that of FIG. 8.

We claim:

1. A scroll type compressor comprised of a fixed scroll member having an end plate and a spiral body formed on the end plate, a movable scroll member having an end plate and a spiral body formed on the end plate and assembled so as to engage with the fixed scroll member shifted from its center, a shaft which receives its rotation to rotate, a bush which is disposed eccentric to the center of rotation of the shaft and gives a revolutionary motion to the movable scroll member, and a rotation preventing mechanism which allows only revolution of the movable scroll member and inhibits free rotation, the revolutionary motion of the movable scroll member being used for movement of the spiral body in the center direction while the hermetic spaces between the movable scroll member and the fixed scroll member are reduced in volume and thereby for compression of the fluid inside the hermetic spaces, the end plate of the movable scroll member having formed on it a portion for engagement with the bush for allowing rotation of the bush and at the same time receiving a revolution drive force, either one of the shaft and the bush being provided with a projection having at least one abutting face, the other of the shaft and the bush being provided with a groove having an abutting face able to come into facial contact with the abutting face of the projection, the groove being engaged with the projection so as to enable the bush to move along the abutting face of the groove, the abutting face being set so as to be inclined with respect to a line passing through the center of the bush and the center of the shaft in a direction opposite to the direction of rotation of the shaft and the abutting face or the extension line of the same passing through the line passing through the center of the bush and the center of the shaft on the side opposite to the side where the center of the bush is present as seen from the center of the shaft.

2. A scroll type compressor as set forth in claim 1, wherein said groove and said projection are each provided with two parallel faces.

3. A scroll type compressor as set forth in claim 1, wherein said projection is provided at the end face of said shaft and said groove is formed at the end face of said bush.

4. A scroll type compressor as set forth in claim 1, wherein said projection is provided at the end face of said bush and said groove is formed at the end face of said shaft.

5. A scroll type compressor as set forth in claim 1, wherein the inclination of said abutting face of said projection and said groove is from 20° to 30° with respect to a line passing through the center of said bush and the center of said shaft.

6. A scroll type compressor as set forth in claim 2, wherein said projection is provided eccentrically with respect to the center of said shaft.

* * * * *